US008209849B2

(12) United States Patent
Sato et al.

(10) Patent No.: US 8,209,849 B2
(45) Date of Patent: Jul. 3, 2012

(54) METHOD FOR PRODUCING MULTILAYER INDUCTOR

(75) Inventors: Hidekazu Sato, Tokyo (JP); Masazumi Arata, Tokyo (JP); Kunio Oda, Tokyo (JP); Yoshimitsu Satoh, Tokyo (JP)

(73) Assignee: TDK Corporation, Tokyo (JP)

( * ) Notice: Subject to any disclaimer, the term of this patent is extended or adjusted under 35 U.S.C. 154(b) by 368 days.

(21) Appl. No.: 12/549,903

(22) Filed: Aug. 28, 2009

(65) Prior Publication Data

US 2010/0108233 A1 May 6, 2010

(30) Foreign Application Priority Data

Oct. 31, 2008 (JP) ..... 2008-282103

(51) Int. Cl.
*H01F 7/06* (2006.01)

(52) U.S. Cl. ..... 29/605; 29/602.1; 29/606; 29/851; 29/854; 336/110; 336/175; 336/178; 336/184; 336/215; 363/17; 363/48; 363/58

(58) Field of Classification Search ..... 29/602.1, 29/605, 606, 609, 840, 843, 851, 854, 860, 29/878, 885; 336/110, 175, 178, 184, 215, 336/234; 363/17, 48, 58
See application file for complete search history.

(56) References Cited

U.S. PATENT DOCUMENTS

| | | | | |
|---|---|---|---|---|
| 6,917,274 | B2 | 7/2005 | Hong et al. | |
| 7,069,639 | B2 * | 7/2006 | Choi et al. | 29/602.1 |

FOREIGN PATENT DOCUMENTS

| | | |
|---|---|---|
| JP | A-2-260405 | 10/1990 |
| JP | A-5-258958 | 10/1993 |
| JP | A-6-310352 | 11/1994 |
| JP | A-11-144958 | 5/1999 |
| JP | A-2004-128506 | 4/2004 |
| JP | A-2005-150168 | 6/2005 |
| JP | A-2006-210403 | 8/2006 |
| JP | A-2006-318946 | 11/2006 |

* cited by examiner

*Primary Examiner* — Paul D Kim
(74) *Attorney, Agent, or Firm* — Oliff & Berridge, PLC

(57) ABSTRACT

A method of A production method including interdiffusion of a Ni component in a magnetic layer and a Zn component in a nonmagnetic sheet to form an interdiffusion layer in a region of the nonmagnetic sheet inside a conductive pattern. This method allows the interdiffusion layer to be formed without need for complicated processing of the nonmagnetic sheet. Furthermore, there is no boundary region between the magnetic layer and the nonmagnetic sheet around it. The nonmagnetic layer is located between turns of a coiled conductor to suppress degradation of dc bias characteristics and a magnetic body penetrates in a region inside the coiled conductor to suppress reduction in inductance due to provision of the nonmagnetic layer between turns of the coiled conductor.

4 Claims, 9 Drawing Sheets

METHOD FOR PRODUCING MULTILAYER INDUCTOR

BACKGROUND OF THE INVENTION

1. Field of the Invention

The present invention relates to a method for producing a multilayer inductor.

2. Related Background of the Invention

The technology related to the field of this kind is, for example, the multilayer inductor described in Patent Document: Japanese Patent Application Laid-open No. 2006-318946. In this conventional multilayer inductor, at least two nonmagnetic layers are formed between turns of a coil except for a region inside the coil and the region inside the coil is in a state in which a magnetic body extends in a lamination direction. In this multilayer inductor, the nonmagnetic layers are provided between the coil turns to suppress sudden reduction in inductance (degradation of dc bias characteristics) due to magnetic saturation of the magnetic body and the magnetic body extends in the region inside the coil to suppress reduction in inductance itself due to the provision of the nonmagnetic layers between the coil turns.

SUMMARY OF THE INVENTION

The configuration of the multilayer inductor as described above is advantageous in that it can ensure both sufficient inductance and dc bias characteristics, but there was the necessity for devising how to locate the magnetic body and the nonmagnetic layers at desired positions. For example, since in the multilayer inductor of the foregoing Patent Document a rectangular magnetic layer is buried in the central region of the nonmagnetic layers (cf. FIG. 1D in the foregoing Patent Document), there is concern about increase in production cost due to processing of the nonmagnetic layers. When the inductor is observed as to the layers forming the laminate, each layer between the coil turns is a single layer made of two different materials and this structure weakens the strength in the boundary region between the nonmagnetic layer and the magnetic layer to raise concern about occurrence of cracking.

The present invention has been accomplished in order to solve the above-mentioned problems and an object of the present invention is to provide a multilayer inductor producing method capable of readily producing a multilayer inductor that can achieve satisfactory inductance and dc bias characteristics together.

In order to solve the above-described problems, a production method of a multilayer inductor according to the present invention is a method for producing a multilayer inductor with a coiled internal conductor in an element body, the method comprising: a preparing step of preparing a magnetic sheet and a nonmagnetic sheet on which a conductive pattern to become a part of the internal conductor is formed; a magnetic layer forming step of forming a magnetic layer on a region of the nonmagnetic sheet inside the conductive pattern; a laminate forming step of superimposing the magnetic sheet on a surface of the nonmagnetic sheet to form a laminate; and a firing step of firing the laminate to induce interdiffusion of a constituent of the magnetic layer and a constituent of the nonmagnetic sheet, thereby forming an interdiffusion layer, which serves as a magnetic body, in the region of the nonmagnetic sheet inside the conductive pattern.

In this production method of the multilayer inductor, the firing step is to induce the interdiffusion of the constituent of the magnetic layer and the constituent of the nonmagnetic sheet to form the interdiffusion layer, which serves as a magnetic body, in the region of the nonmagnetic sheet inside the conductive pattern. This method permits the interdiffusion layer to be formed in the region inside the conductive pattern, without need for complicated processing of the nonmagnetic sheet, and thus keeps the production cost at a reasonable level. There is no boundary region formed between the interdiffusion layer and the nonmagnetic layer around it, thereby suppressing the occurrence of cracking.

Preferably, the magnetic layer forming step comprises forming the magnetic layer containing a nickel (Ni) component, on the nonmagnetic sheet containing a zinc (Zn) component, and the firing step comprises inducing interdiffusion of the Ni component in the magnetic layer and the Zn component in the nonmagnetic sheet. The Curie point of a magnetic body can be controlled by a content of the Zn component. Furthermore, a Zn content in the interdiffusion layer can be controlled by a difference between a Zn content in the nonmagnetic sheet and a Zn content in the magnetic layer. Therefore, the foregoing steps allow the characteristics of the interdiffusion layer to be made closer to desired characteristics.

Preferably, the laminate forming step comprises superimposing the magnetic sheet and the nonmagnetic sheet each in multiple layers. In this case, the aforementioned effects can be achieved with the multilayer inductor with a large number of turns of the coiled internal conductor.

Preferably, the magnetic layer forming step comprises forming the magnetic layer in a region of the nonmagnetic sheet outside the conductive pattern, and the firing step comprises further forming the interdiffusion layer in the region of the nonmagnetic sheet outside the conductive pattern. This configuration further improves the dc bias characteristics of the multilayer inductor.

As described above, the present invention permits the multilayer inductor to be produced by the simple method, while ensuring satisfactory inductance and dc bias characteristics together.

DESCRIPTION OF THE PREFERRED EMBODIMENTS

The preferred embodiments of the production method of the multilayer inductor according to the present invention will be described below in detail with reference to the drawings.

Figure 1:
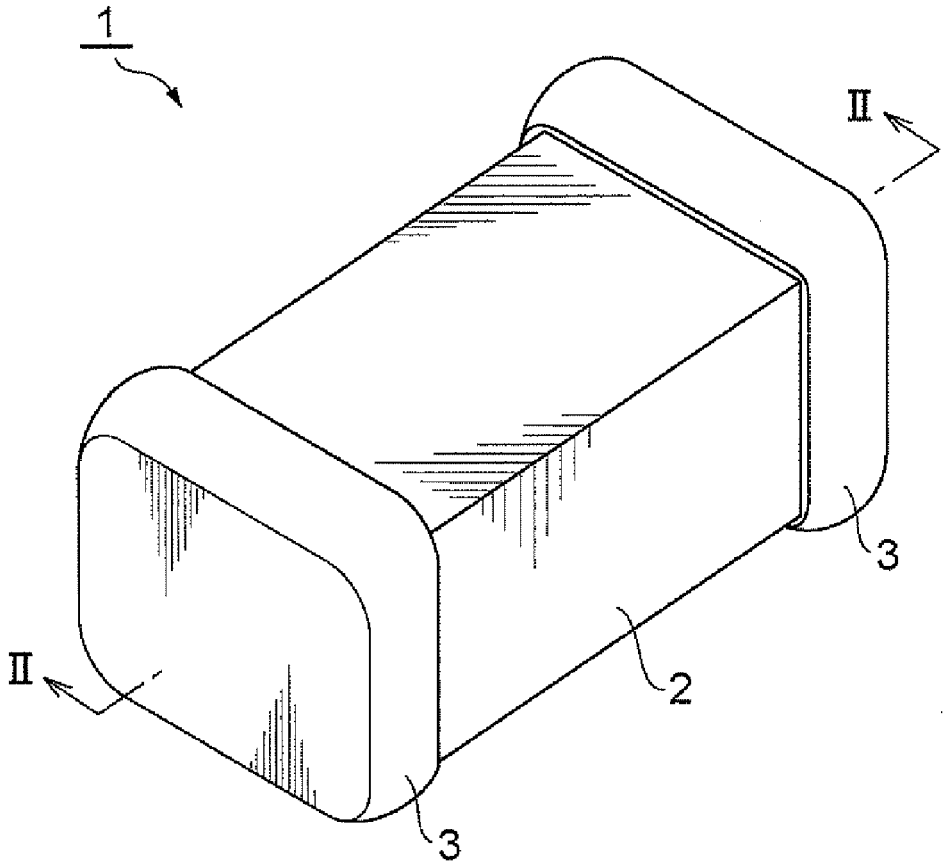
FIG. 1 is a drawing showing an embodiment of a multilayer inductor produced by the production method of the multilayer inductor according to the present invention.
Figure 2:
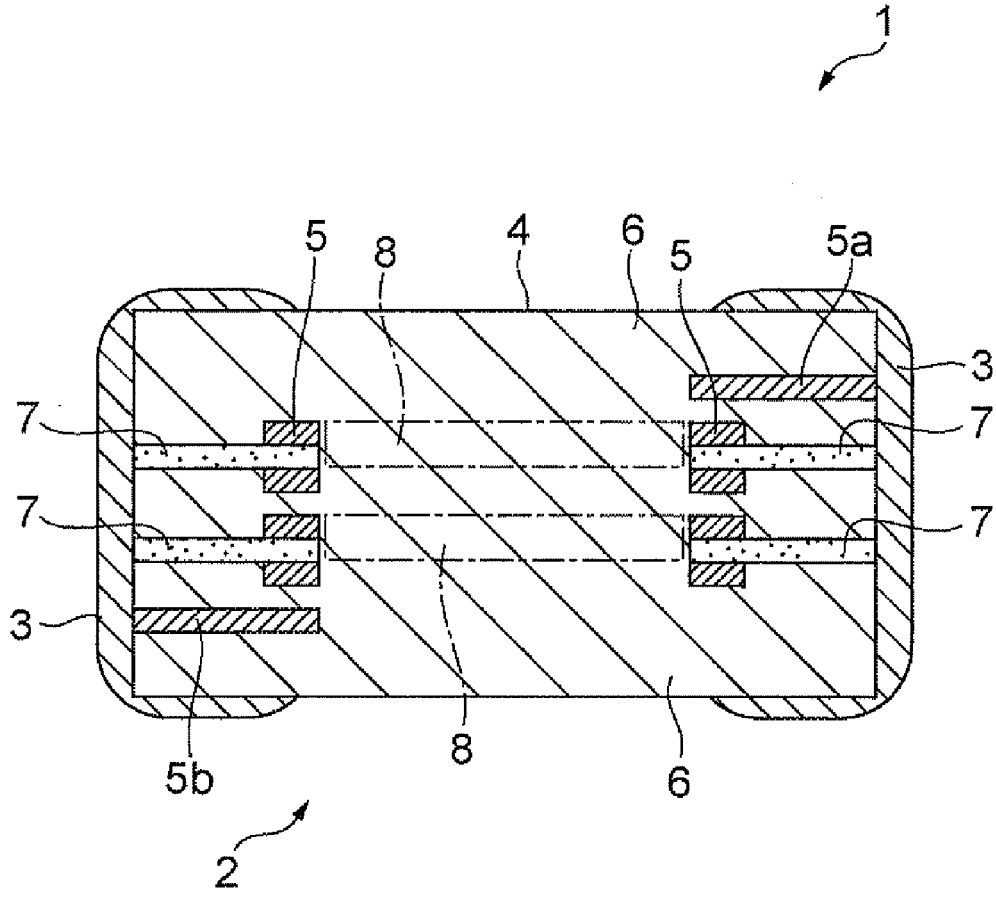
FIG. 2 is a sectional view along line II-II in FIG. 1.

FIG. 1 is a drawing showing an embodiment of the multilayer inductor produced by the production method of the multilayer inductor according to the present invention. FIG. 2 is a sectional view along line II-II in FIG. 1. As shown in FIGS. 1 and 2, the multilayer inductor 1 has an element 2 of a rectangular parallelepiped shape, and a pair of terminal electrodes 3, 3 formed so as to cover the two longitudinal ends of the element 2.

The element 2 is composed of a multilayer section 4 including magnetic layers 6 and nonmagnetic layers 7 made of a ferrite material and additives, and an internal conductor arranged in the multilayer section 4 and wound in a coil shape (which will be referred to hereinafter as coiled conductor 5).

The coiled conductor 5 is made, for example, of an electroconductive material such as Ag. Lead portions 5*a*, 5*b* of the coiled conductor 5, as shown in FIG. 2, are drawn out to the two longitudinal ends of the element 2 and connected to respective terminal electrodes 3, 3. The coiled conductor 5 of this configuration is constructed by a series of conductive patterns 10 (cf. FIG. 3) obtained by printing and stacking of an electroconductive paste. The number of turns of the coiled conductor 5 is optionally determined according to frequency characteristics of impedance to be obtained and is four in the present embodiment.

The nonmagnetic layers 7 of the multilayer section 4 are formed, for example, in a layer located between the first turn and the second turn of the coiled conductor 5 and in a layer located between the third turn and the fourth turn of the coiled conductor when viewed from the lead portion 5*a* side. The nonmagnetic layers 7, as shown in FIG. 2, extend between the upper and lower turns of the coiled conductor 5, 5 and across the region outside the coiled conductor 5, except for the region inside the coiled conductor 5, and outer edges of the nonmagnetic layers 7 reach the end faces of the element body 2.

The magnetic layers 6 of the multilayer section 4 are located in the portions excluding the above-described nonmagnetic layers 7. Formed in the region inside the coiled conductor 5 are two, upper and lower layers of interdiffusion layers 8 formed by interdiffusion of a Ni component in magnetic layers 13 and a Zn component in nonmagnetic sheets 12 described below. The interdiffusion layers 8 are magnetic bodies, and the magnetic layers 6 and interdiffusion layers 8 allow the region inside the coiled conductor 5 in the multilayer section 4 to be maintained in a state in which the magnetic bodies penetrate in the lamination direction.

The "magnetic" property stated herein refers, for example, to demonstration of magnetism in a temperature range of −55° C. to 125° C. including room temperature (25° C.), and the "nonmagnetic" property refers to no demonstration of magnetism in the same temperature range.

The following will describe a production method of the multilayer inductor 1 described above.

Figure 3:
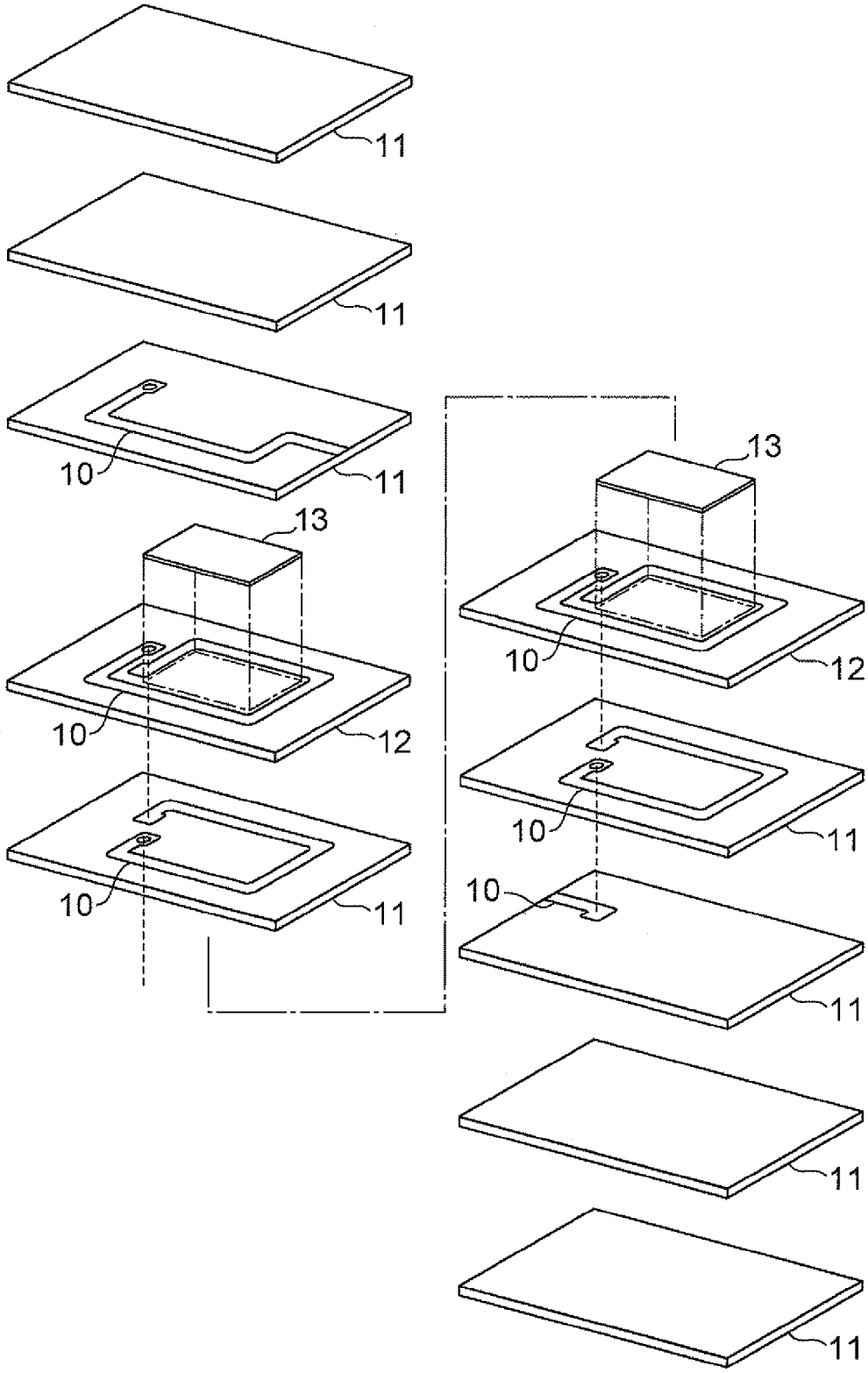
FIG. 3 is an exploded perspective view showing magnetic sheets and nonmagnetic sheets forming the multilayer inductor.

First prepared are magnetic sheets 11 and nonmagnetic sheets 12 on each of which a conductive pattern 10 to become a part of the coiled conductor 5 is formed, as shown in FIG. 3. The magnetic sheets 11 and nonmagnetic sheets 12 are formed using a ferrite paste and a conductive paste. The ferrite paste is prepared by kneading a ferrite powder, an additive, and an organic vehicle.

The organic vehicle contains a binder and an organic solvent. The binder applicable herein is, for example, one of various resins such as polyvinyl acetal resin, ethyl cellulose, cellulose nitrate, acrylic, phenol, urethane, polyester, rosin, maleic acid, melamine, and urea resin. The organic solvent applicable herein is, for example, one of alcohols (ethanol, methanol, propanol, butanol, terpineol, and so on), ketones (acetone and others), cellosolves (methyl cellosolve, ethyl cellosolve, and so on), esters (methyl acetate, ethyl acetate, and so on), ethers (ethyl ether, butyl carbitol, and so on), and others.

The conductive paste is prepared by mixing a conductive powder with a binder and organic solvent at a predetermined ratio and kneading them. The kneading can be implemented by three rolls, a homogenizer, a sand mill, or the like. The conductive powder is, normally, Ag, Ag alloy, Cu, Cu alloy, or the like, and is preferably Ag with small resistivity.

Next, the aforementioned ferrite paste is laid up to a predetermined thickness by printing to form ferrite green layers. Then the ferrite green layers are dried to obtain magnetic sheets 11 to become the magnetic layers 6 in the element 2 and nonmagnetic sheets 12 to become the nonmagnetic layers 7 in the element 2.

The Curie point of the ferrite green layers and sintered bodies thereof can be controlled, mainly, by increasing or decreasing the Zn component contained in the ferrite paste. As an example, the magnetic sheets 11 can be formed using a ferrite paste which contains $Fe_2O_3$, NiO, CuO, and ZnO and which has the $Fe_2O_3$ content of 48.75 mol %, the NiO content of 16.00 mol %, the CuO content of 8.35 mol %, and the ZnO content of 26.9 mol %. The nonmagnetic sheets 12 can be formed using a ferrite paste which contains $Fe_2O_3$, CuO, and ZnO and which has the $Fe_2O_3$ content of 48.50 mol %, the CuO content of 12.20 mol %, and the ZnO content of 39.3 mol %.

After the magnetic sheets 11 and nonmagnetic sheets 12 are obtained, the aforementioned conductive paste is printed in a predetermined pattern on surfaces thereof Then the conductive paste is dried to form the conductive patterns 10, each of which becomes a part of the coiled conductor 5, on the surfaces of the magnetic sheets 11 and nonmagnetic sheets 12.

Next, rectangular magnetic layers 13 are printed in regions inside the conductive patterns 10 on the nonmagnetic sheets 12. The magnetic layers 13 can be formed, for example, using a ferrite paste which contains $Fe_2O_3$, NiO, CuO, ZnO, and CoO and which has the $Fe_2O_3$ content of 44.65 mol %, the NiO content of 47.40 mol %, the CuO content of 6.95 mol %, the ZnO content of 1.00 mol %, and the CoO content of 1.36 mol %.

Figure 4:
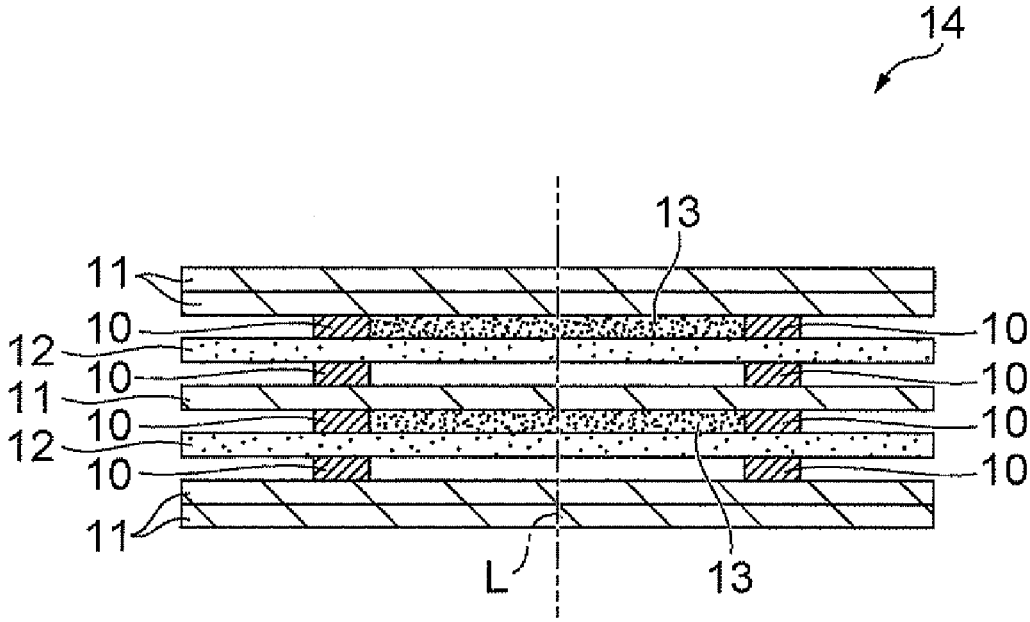
FIG. 4 is a sectional view showing a layer structure of a laminate element before fired.

After the magnetic layers 13 are printed, the magnetic sheets 11 are stacked in multiple layers on the surfaces of the nonmagnetic sheets 12, as shown in FIG. 4. Furthermore, the magnetic sheets 11 with the conductive patterns 10 to become the lead portions 5*a*, 5*b*, and a plurality of magnetic sheets 11 without any conductive pattern 10 are stacked on the top and bottom in the lamination direction. This completes a laminate 14 corresponding to the multilayer section 4.

Next, the laminate 14 is cut in a predetermined size. Since the laminate 14 normally has a wafer structure in which a plurality of element units are arrayed, one laminate element is obtained by cutting the wafer-shaped laminate 14 in the predetermined size. At this time, the wafer-shaped laminate 14 is cut so that the conductive patterns 10 corresponding to the lead portions 5*a*, 5*b* are exposed from respective end faces of the laminate element. Thereafter, the resultant laminate element is subjected to debindering in the presence of oxygen, for example, at 350-500° C.

Figure 5:
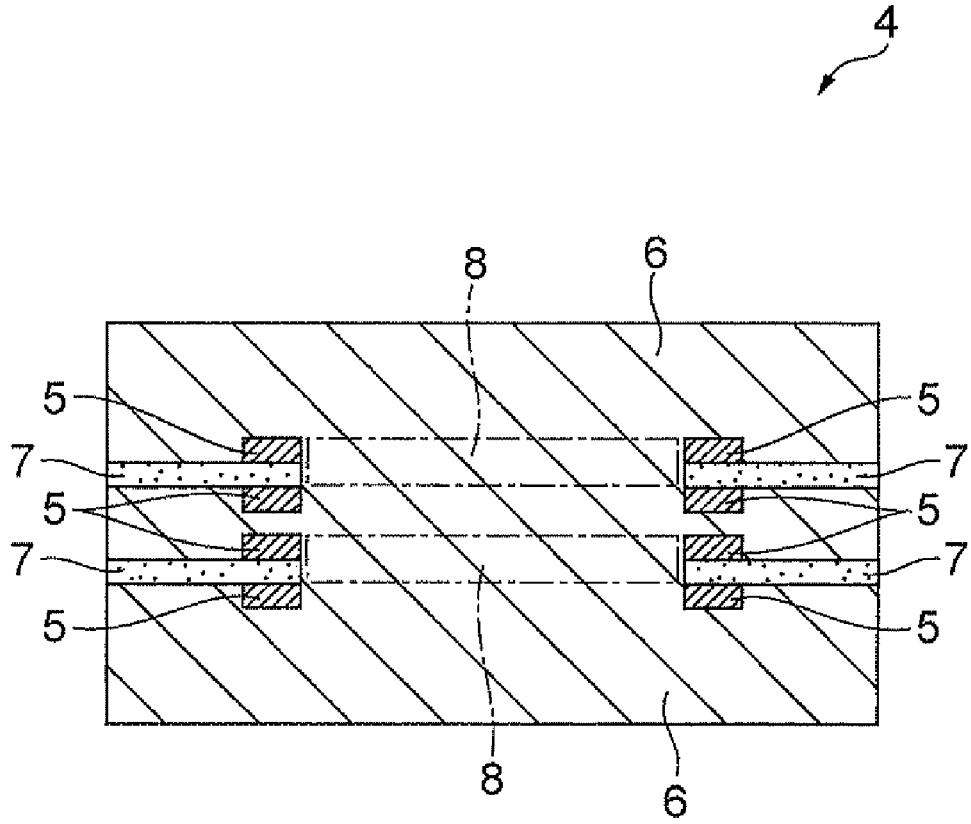
FIG. 5 is a sectional view showing a layer structure of a laminate element after fired.

After the debindering, the laminate element is integrally fired, for example, at 850-920° C. for one to two hours. This process results in sintering the laminate 14 and conductive patterns 10 and obtaining the element 2, as shown in FIG. 5. During this firing, there occurs interdiffusion of the Zn component in the nonmagnetic sheets 12 and the Ni component in the magnetic layers 13 formed on the regions of the nonmagnetic sheets 12 inside the conductive patterns 10.

This interdiffusion of the Zn component and the Ni component results, for example, in decreasing the ZnO content from 39.3 mol % to about 25 mol % in the regions of the nonmagnetic sheets 12 inside the conductive patterns. On the other hand, for example, the ZnO content increases from 1.00 mol % to about 15 mol % in the magnetic layers 13. This interdiffusion results in forming interdiffusion layers 8 which demonstrate the magnetic property in the temperature range of −55° C. to 125° C.

Next, an electroconductive paste consisting mainly of Ag is applied onto side faces where the end faces of the lead portions 5*a*, 5*b* of the coiled conductor 5 are exposed, in the element 2 obtained by firing, and it is fired, for example, at about 600° C. to form the terminal electrodes 3, 3. Thereafter, the terminal electrodes 3, 3 are subjected to electroplating, thereby completing the multilayer inductor 1 shown in FIGS. 1 and 2. The electroplating is preferably carried out using copper, nickel, and tin; nickel and tin; nickel and gold; or, nickel and silver.

As described above, the production method of the multilayer inductor 1 according to the present embodiment includes the firing step to induce the interdiffusion of the Ni component in the magnetic layers 13 and the Zn component in the nonmagnetic sheets, thereby forming the interdiffusion layers 8 in the regions of the nonmagnetic sheets 12 inside the conductive patterns 10. This method permits the interdiffusion layers 8 to be formed in the regions of the nonmagnetic layers 7 inside the coiled conductor 5, without need for complicated processing of the nonmagnetic sheets 12, and thus can reduce the production cost. Since no boundary region is formed between the interdiffusion layers 8 and the nonmagnetic layers 7 around them, occurrence of cracking is also suppressed.

In the resultant multilayer inductor 1, the nonmagnetic layers 7 are located between turns of the coiled conductor 5, 5, which can suppress sudden reduction in inductance (degradation of dc bias characteristics) due to magnetic saturation of the magnetic body. Since the magnetic body penetrates in the lamination direction of the element 2 in the region inside the coiled conductor 5, it is feasible to suppress reduction in inductance itself due to the provision of the nonmagnetic layers 7 between turns of the coiled conductor 5, 5. As the magnetic sheets 11 and the nonmagnetic sheets 12 are superimposed in multiple layers, the aforementioned effects can be achieved with a multilayer inductor having a large number of turns of the coiled conductor 5 like the multilayer inductor 1.

In this production method of the multilayer inductor, the Curie point of the magnetic body is controlled mainly by the content of the Zn component. The content of the Zn component in the interdiffusion layers 8 can be controlled by a difference between the content of the Zn component in the nonmagnetic sheets 12 and the content of the Zn component in the magnetic layers 13. This allows the characteristics of the interdiffusion layers 8 to be readily made closer to desired characteristics. Since the magnetic layers 13 can be formed at any position and in any size on the nonmagnetic sheets 12 by printing or the like, it is feasible to readily control the inductance and dc bias characteristics of the multilayer inductor 1.

Figure 6:
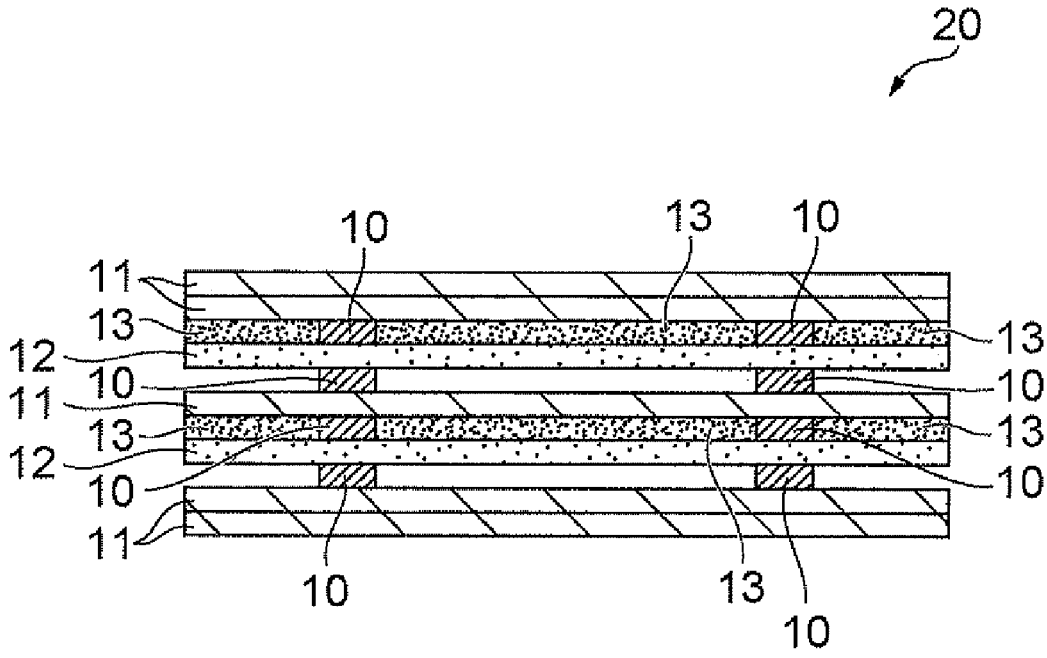
FIG. 6 is a sectional view showing a modification example of the layer structure of the laminate element before fired.
Figure 7:
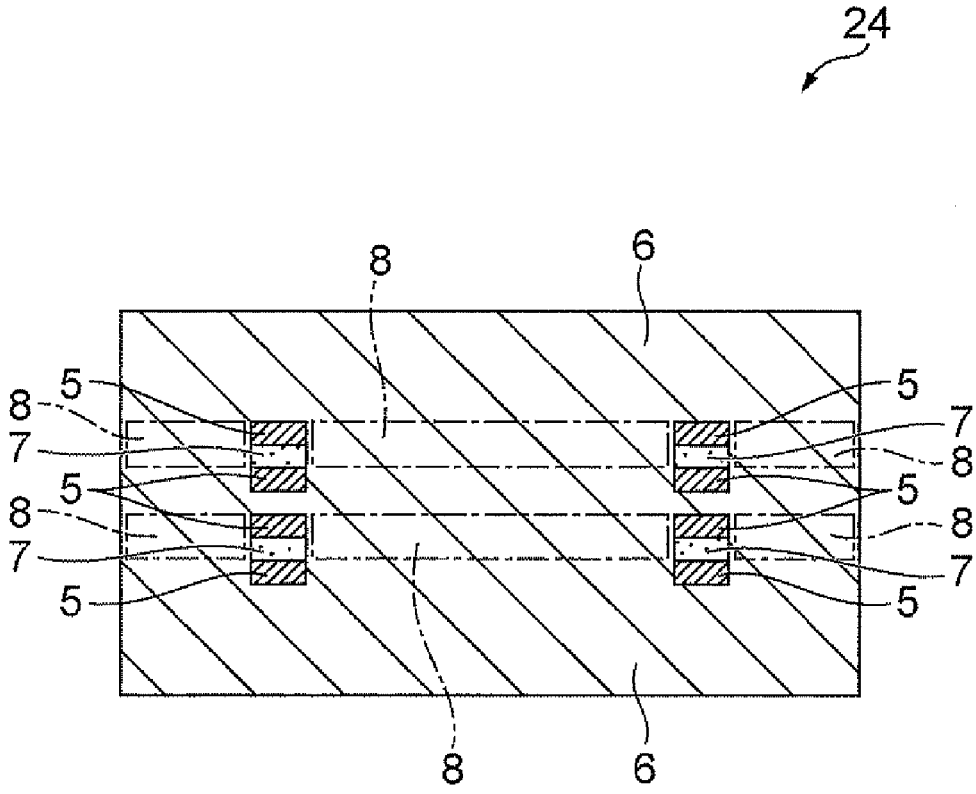
FIG. 7 is a sectional view showing a modification example of the layer structure of the laminate element after fired.

Concerning the formation of the magnetic layers 13 on the nonmagnetic sheets 12, the magnetic layers 13 may also be formed in the regions outside the conductive patterns 10, in addition to the regions inside the conductive patterns 10, for example, as shown in FIG. 6. In a multilayer section 24 obtained by firing a laminate 20 of this configuration, as shown in FIG. 7, the nonmagnetic layers 7 are formed only between the upper and lower turns of the coiled conductor 5, 5 in the layer located between the first turn and the second turn of the coiled conductor 5 and in the layer located between the third turn and the fourth turn of the coiled conductor.

In the multilayer section 24, the respective interdiffusion layers 8, 8 resulting from the interdiffusion of the Ni component in the magnetic layers 13 and the Zn component in the nomagnetic sheets 12 are formed as two, upper and lower layers in both of the region inside the coiled conductor 5 and the region outside the coiled conductor 5. In the multilayer section 24, therefore, the magnetic body penetrates in the lamination direction in the regions inside and outside the coiled conductor 5. This configuration can further improve the dc bias characteristics of the multilayer inductor.

Finally, the below will describe the result of study on the interdiffusion layers formed by interdiffusion of the Zn component and the Ni component.

Figure 8:
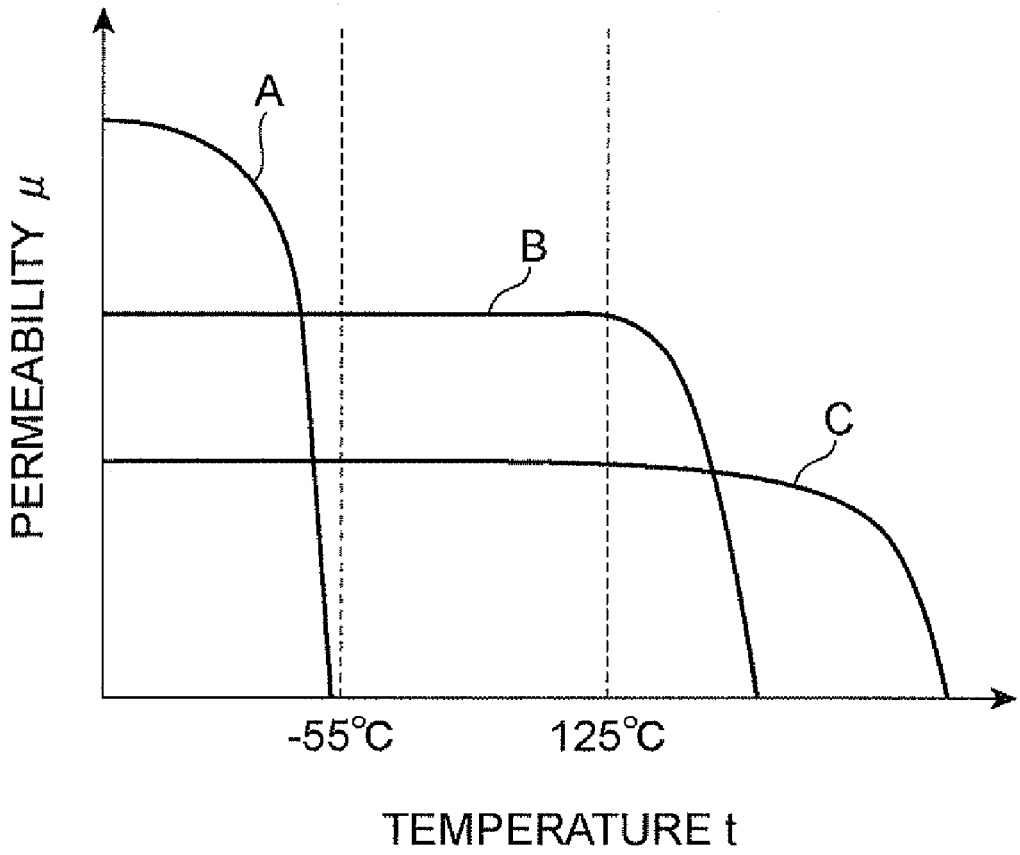
FIG. 8 is a drawing showing a relation of permeability and temperature, for ferrite green layers of different contents of the Zn component and sintered bodies thereof.

The Curie point of a ferrite green layer and sintered body thereof can be controlled by increasing or decreasing the Zn component contained in the ferrite paste. FIG. 8 is a drawing showing a relation of permeability and temperature, for ferrite green layers of different contents of the Zn component and sintered bodies thereof.

As shown in the same drawing, in a case where the content of the Zn component is, for example, 38.3 mol % or more, the Curie point is below −55° C. and the ferrite green layer and sintered body thereof become nonmagnetic bodies in the temperature range of −55° C. to 125° C. (graph A). As the content of the Zn component is reduced from 38.3 mol %, the Curie point varies to above −55° C.

When the content of the Zn component is, for example, 32.1 mol % or less, the Curie point becomes over 125° C. and the ferrite green layer and sintered body thereof become magnetic bodies in the temperature range of −55° C. to 125° C. (graph B). As the content of the Zn component is further reduced, the Curie point becomes much higher. In this case, the ferrite green layer and sintered body thereof also become magnetic bodies in the temperature range of −55° C. to 125° C., but values of permeability μ thereof decrease below the graph B (graph C).

On the other hand, a content of the Zn component in an interdiffusion layer resulting from the interdiffusion of the Zn component and the Ni component during firing tends to become closer to an intermediate value between contents of the Zn component in adjacent ferrite green layers. Therefore, when a ferrite green layer (nonmagnetic) with the content of the Zn component of 37.5 mol % and a ferrite green layer (magnetic), for example, with the content of the Zn component of 30.1 mol % as shown in FIG. 8 are fired in an adjacent state, a content of the Zn component in sintered bodies thereof becomes approximately 33.8 mol % (magnetic).

In the aforementioned embodiment, the content of the Zn component in the nonmagnetic sheets 12 is 39.3 mol % and the content of the Zn component in the magnetic layers 13 on the nonmagnetic sheets 12 is 1.00 mol %. Therefore, the content of the Zn component in the interdiffusion layers 8 becomes approximately 20 mol %, The interdiffusion takes place strongly near the boundary between the nonmagnetic sheet 12 and the magnetic layer 13. For this reason, the content of the Zn component is not always uniform in the interdiffusion layers 8 and has a distribution according to distance from the boundary.

Figure 9:
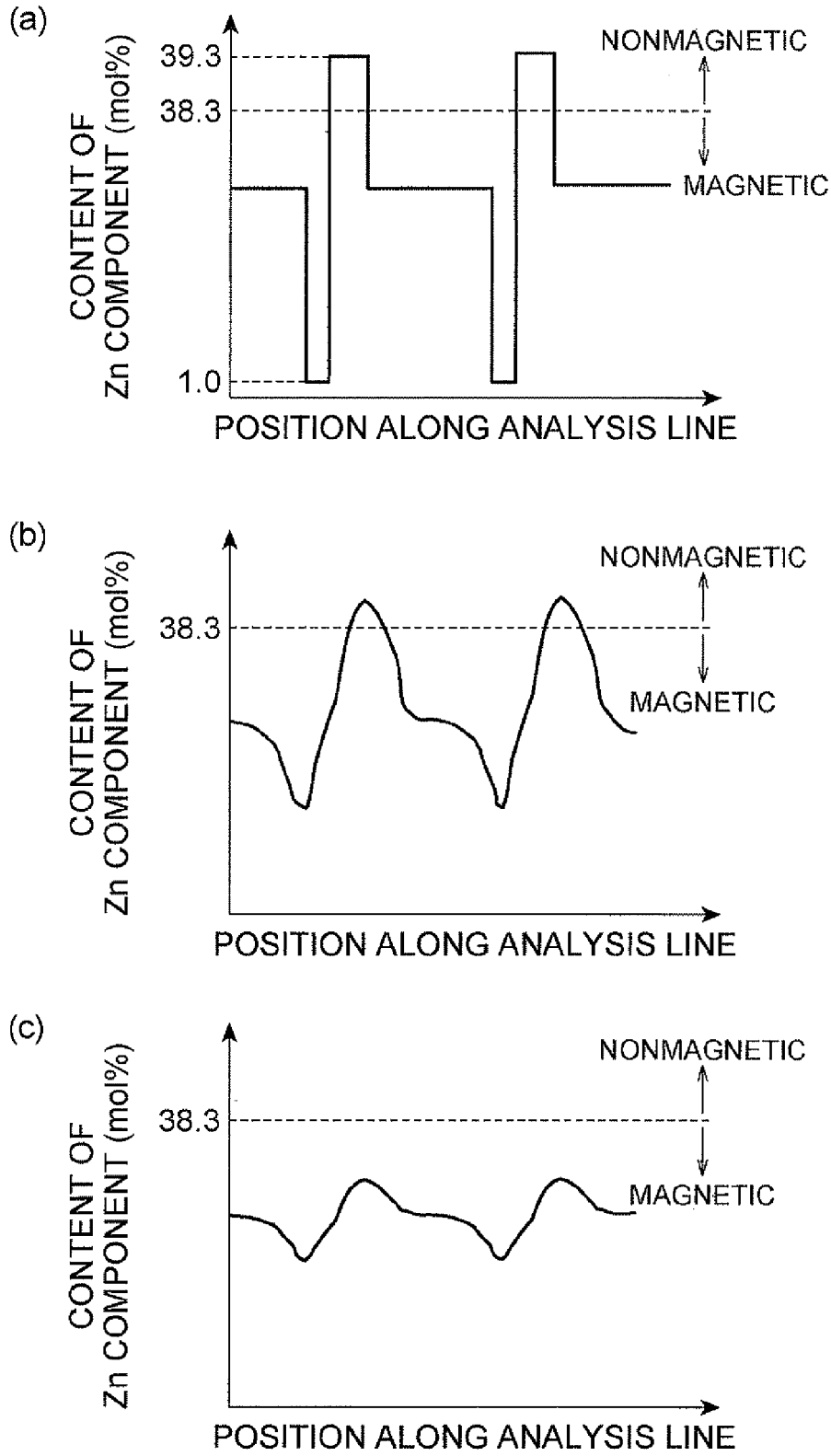
FIG. 9 is simulation results showing states of variation in content of the Zn component in ferrite green layers in the firing step.

FIG. 9 is a drawing showing variation in content of the Zn component in the laminate 14 from before firing to after firing, along an analysis line L (cf. FIG. 4) set along the lamination direction in the region inside the coiled conductor 5. In a state before firing, the laminate includes the magnetic sheets 11 with the content of the Zn component of 26.9 mol %, the magnetic layers 13 with the content of the Zn component of 1.00 mol %, and the nonmagnetic sheets 12 with the content of the Zn component of 39.3 mol %, and therefore a waveform pattern of content of the Zn component along the analysis line L is a stepwise and periodic waveform pattern as shown in FIG. 9 (*a*).

During the firing process, interdiffusion proceeds of the Ni component in the magnetic layers 13 and the Zn component in the nonmagnetic sheets 12 to gradually increase the content of the Zn component in the magnetic layers 13 and gradually decrease the content of the Zn component in the nonmagnetic sheets 12 in contrast. In a state during the firing, as shown in FIG. 9 (*b*), a waveform pattern of content of the Zn component along the analysis line L is a periodic waveform pattern having peaks corresponding to the positions of the nonmagnetic sheets 12 and bottoms corresponding to the positions of the magnetic layers 13, which is dulled at shoulders of the waveform pattern shown in FIG. 9 (*a*).

In a state after the firing, interdiffusion further proceeds of the Ni component in the magnetic layers 13 and the Zn component in the nonmagnetic sheets 12, whereby the content of the Zn component in the interdiffusion layers 8 becomes below 37.5 mol %. This makes the magnetic body penetrate in the lamination direction in the region inside the coiled conductor 5. In the state after the firing, a waveform pattern of content of the Zn component along the analysis line L, as shown in FIG. 9 (*c*), becomes a periodic waveform pattern in which the contents of the Zn component at peaks and the contents of the Zn component at bottoms are closer to each other than in the waveform pattern of FIG. 9 (*b*).

What is claimed is:

1. A method for producing a multilayer inductor with a coiled internal conductor in an element body, the method comprising:

a preparing step of preparing a magnetic sheet and a nonmagnetic sheet on which a conductive pattern to become a part of the internal conductor is formed;

a magnetic layer forming step of forming a magnetic layer on a region of the nonmagnetic sheet inside the conductive pattern;

a laminate forming step of superimposing the magnetic sheet on a surface of the nonmagnetic sheet to form a laminate; and a firing step of firing the laminate to induce interdiffusion of a constituent of the magnetic layer and a constituent of the nonmagnetic sheet, thereby forming an interdiffusion layer, which serves as a magnetic body, in the region of the nonmagnetic sheet inside the conductive pattern.

2. The method according to claim 1, wherein the magnetic layer forming step comprises forming the magnetic layer containing a nickel (Ni) component, on the nonmagnetic sheet containing a zinc (Zn) component, and wherein the firing step comprises inducing interdiffusion of the Ni component in the magnetic layer and the Zn component in the nonmagnetic sheet.

3. The method according to claim 1, wherein the laminate forming step comprises superimposing the magnetic sheet and the nonmagnetic sheet each in multiple layers.

4. The method according to claim 1, wherein the magnetic layer forming step further comprises forming a magnetic layer on a region of the nonmagnetic sheet outside the conductive pattern, and wherein the firing step further comprises forming an interdiffusion layer in a region of the nonmagnetic sheet outside the conductive pattern.

* * * * *